US011700490B2

(12) United States Patent
Zhou et al.

(10) Patent No.: US 11,700,490 B2
(45) Date of Patent: Jul. 11, 2023

(54) SPEAKER

(71) Applicant: AAC Microtech (Changzhou) Co., Ltd., Changzhou (CN)

(72) Inventors: Keyong Zhou, Shenzhen (CN); Xudong Yan, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 75 days.

(21) Appl. No.: 17/547,253

(22) Filed: Dec. 10, 2021

(65) Prior Publication Data

US 2022/0210571 A1 Jun. 30, 2022

(30) Foreign Application Priority Data

Dec. 28, 2020 (CN) ..... 202011575999.4

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 9/04* (2013.01); *H04R 2400/11* (2013.01)

(58) Field of Classification Search

None

See application file for complete search history.

(56) References Cited

U.S. PATENT DOCUMENTS

2004/0008101 A1* 1/2004 Trandafir ..... H04R 9/046 335/229

FOREIGN PATENT DOCUMENTS

WO WO-2015049218 A1 * 4/2015 ..... H04R 9/063

* cited by examiner

*Primary Examiner* — Walter F Briney, III

(74) *Attorney, Agent, or Firm* — W&G Law Group

(57) ABSTRACT

The present disclosure provides a speaker, including a frame, a vibration system, a magnetic circuit system, the vibration system includes a first diaphragm and a second diaphragm which are fixed to two opposite sides of the frame, a first voice coil to drive the first diaphragm to vibrate, and a second voice coil assembly to drive the second diaphragm to vibrate. The vibration system further includes a first elastic wave assembly and a second elastic wave assembly which are fixed to the frame and are spaced from each other. The first elastic wave assembly and the second elastic wave assembly are in staggered distribution and antiphase vibration. By means of the staggered distribution of the first elastic wave assembly and the second elastic wave assembly, the first elastic wave assembly and the second elastic wave assembly make reasonable use of an internal space of the speaker.

9 Claims, 10 Drawing Sheets

SPEAKER

TECHNICAL FIELD

The present invention relates to the technical field of electroacoustic conversion, in particular to a speaker.

BACKGROUND

In the vehicle-mounted speaker industry, a traditional cone speaker is generally used. At present, the automobiles have higher requirements for high sound quality, flexible layout, low power consumption, and small vibration of horns (speakers).

A vehicle-mounted speaker of the related art includes a frame, a vibration system fixed to the frame, and a magnetic circuit system with a magnetic gap. The magnetic circuit system drives the vibration system to vibrate and produce sounds, wherein the vibration system includes a diaphragm fixed to the frame, and a voice coil assembly which is fixed to the diaphragm and inserted into the magnetic gap to drive the diaphragm to vibrate and produce sounds. However, this speaker has the problems of large structural size, low efficiency, and great low-frequency vibration.

SUMMARY

The present invention aims to provide an ultra-thin speaker with an increased space utilization rate.

In order to achieve the above objective, the present invention provides a speaker comprising a frame, a vibration system fixed to the frame, and a magnetic circuit system having a magnetic gap.

The vibration system comprises a first diaphragm and a second diaphragm which are fixed to two opposite sides of the frame, a first voice coil assembly inserted into the magnetic gap to drive the first diaphragm to vibrate and produce sounds, and a second voice coil assembly inserted into the magnetic gap to drive the second diaphragm to vibrate and produce sounds;

the first diaphragm comprises a first dome located in center, a first curved ring which surrounds the first dome and is fixed to the frame, and a first dome connecting wall formed by extending from the first dome towards the first voice coil assembly; the second diaphragm comprises a second dome located in the center, a second curved ring which surrounds the second dome and is fixed to the frame, and a second dome connecting wall formed by extending from the second dome towards the second voice coil assembly; the first dome and the first dome connecting wall, and the second dome and the second dome connecting wall are integrated respectively;

the vibration system further comprises a first elastic wave assembly and a second elastic wave assembly which are fixed to the frame and are spaced from each other; one end of the first elastic wave assembly away from the frame is connected to the first dome connecting wall; one end of the second elastic wave assembly away from the frame is connected to the second dome connecting wall; and the first elastic wave assembly and the second elastic wave assembly are in staggered distribution and have antiphase vibration.

Preferably, the frame comprises a first frame for fixing the first diaphragm and a second frame for fixing the second diaphragm; the first frame is stacked on the second frame along a vibration direction of the vibration system; a mounting part is convexly arranged on one side of the first frame facing the second frame; an avoiding part matched with the mounting part is sunken in a position corresponding to the mounting part on the second frame; or, a mounting part is convexly arranged on one side of the second frame facing the first frame; and an avoiding part matched with the mounting part is sunken in a position corresponding to the mounting part on the first frame.

Preferably, there are four first dome connecting walls and four second dome connecting walls, as well as four first elastic wave assemblies and four second elastic wave assemblies.

Preferably, the frame further comprises a fixing sheet arranged between the first frame and the second frame; a part of the first elastic wave assembly is fixed between the first frame and the second frame through the fixing sheet; or, a part of the second elastic wave assembly is fixed between the first frame and the second frame through the fixing sheet.

Preferably, the first curved ring comprises a first curved ring main body with annular shape, a first fixed part which extends in a bent manner from an outer circumference of the first curved ring main body and is fixed to the first frame, and a first connection part extending in a bent manner from an inner circumference of the first curved ring main body; the first dome is fixed to the first connection part; the second curved ring comprises a second curved ring main body with annular shape, a second fixed part which extends in a bent manner from an outer circumference of the second curved ring main body and is fixed to the second frame, and a second connection part extending in a bent manner from an inner circumference of the second curved ring main body; and the second dome is fixed to the second connection part.

Preferably, the first frame comprises a frame body, a supporting part spaced from the frame body, and a plurality of frame extending arms extending from the frame body to the supporting part; a through hole that runs through the supporting part and fixes the magnetic circuit system is formed in the supporting part along the vibration direction; or, the second frame comprises a frame body, a supporting part spaced from the frame body, and a plurality of frame extending arms extending from the frame body to the supporting part; and a through hole that runs through the supporting part and fixes the magnetic circuit system is formed in the supporting part along the vibration direction.

Preferably, the magnetic gap comprises a first magnetic gap close to one side of the first diaphragm, and a second magnetic gap which is close to one side of the second diaphragm and spaced from the first magnetic gap.

Preferably, the first voice coil assembly comprises a first voice coil bobbin fixed to the first diaphragm and a first voice coil wound on the first voice coil bobbin; the first voice coil is at least partially located in the first magnetic gap; the second voice coil assembly comprises a second voice coil bobbin fixed to the second diaphragm and a second voice coil wound on the second voice coil bobbin; and the second voice coil is at least partially located in the second magnetic gap.

Preferably, the first voice coil bobbin further comprises a first leakage hole running through the first voice coil bobbin, and the second voice coil bobbin further comprises a second leakage hole running through the second voice coil bobbin.

The present invention has the beneficial effects: a speaker is provided, the vibration system of which comprises the first diaphragm and the second diaphragm which are fixed to the two opposite sides of the frame. Furthermore, by means of the staggered distribution of the first elastic wave assembly and the second elastic wave assembly, the first elastic wave assembly and the second elastic wave assembly make reasonable use of an internal space of the speaker, so that the height of the speaker is reduced, and thinning development is facilitated.

DETAILED DESCRIPTION OF THE EMBODIMENTS

The present invention is further described below in combination with the accompanying drawings and embodiments.

It should be noted that all directional indications (such as up, down, left, right, front, rear, inner, outer, top, bottom, . . . ) in the embodiments of the present invention are only used for explaining relative position relationships between all components at a certain specific attitude (as shown in the figures). If this specific position changes, the directional indication also correspondingly changes with it.

Referring to FIG. 1 to FIG. 10, a speaker provided by the embodiments of the present invention is illustrated, which includes a frame 10, a vibration system 20, and a magnetic circuit system 30 with a magnetic gap. In particular, the magnetic circuit system 30 is configured for driving the vibration system 20 to vibrate and produce sounds. The frame 10 is configured for fixing the vibration system 20 and the magnetic circuit system 30.

Figure 1:
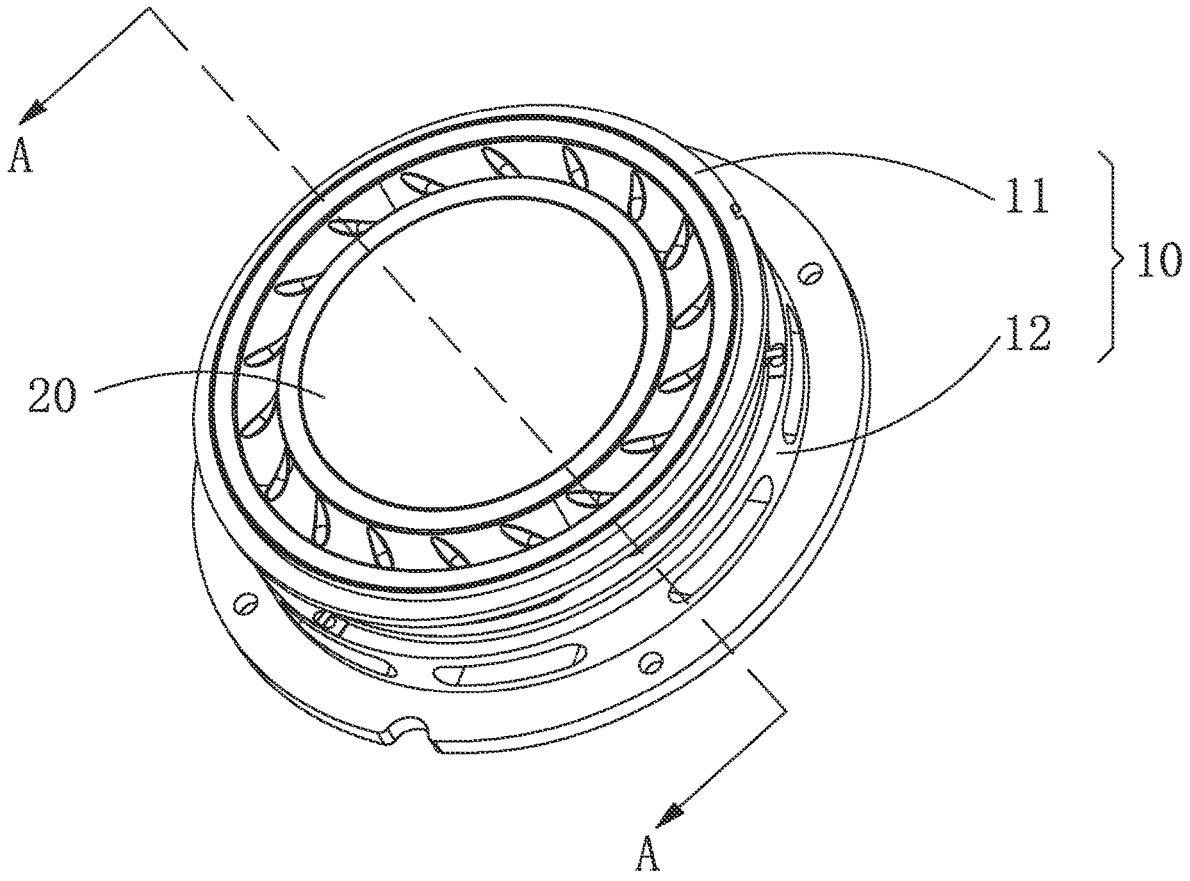
FIG. 1 is a schematic diagram of a three-dimensional structure of a speaker provided by the present invention.
Figure 2:
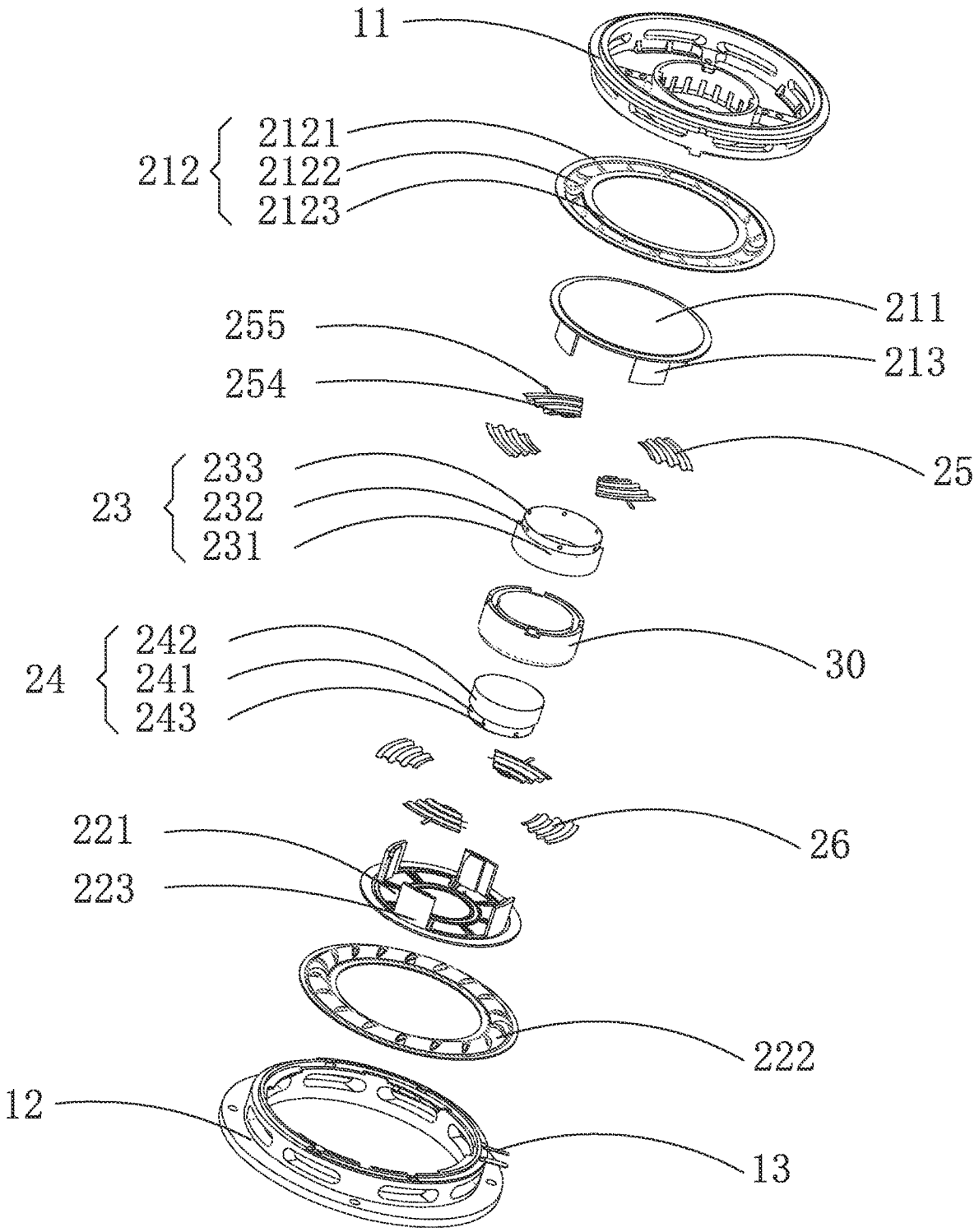
FIG. 2 is a schematic diagram of an exploded three-dimensional structure of a speaker provided by the present invention.
Figure 3:
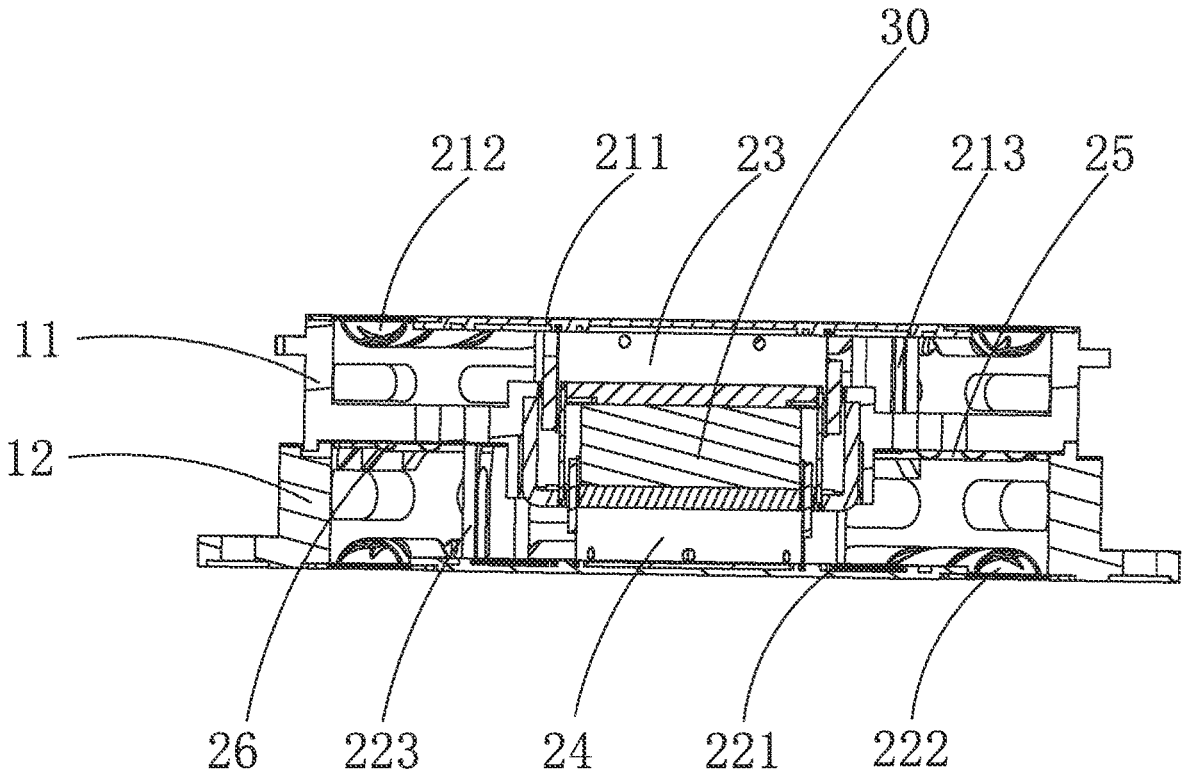
FIG. 3 is a cutaway view of FIG. 1 along the A-A direction.

Referring to FIG. 1 to FIG. 3, the vibration system 20 includes a first diaphragm 21 and a second diaphragm 22 which are respectively fixed on two opposite sides of the frame 10, and the magnetic circuit system 30 is located between the first diaphragm 21 and the second diaphragm 22. In the speaker of the present invention, the first diaphragm 21 and the second diaphragm 22 on the two opposite sides are used for producing sounds in a radiated manner. The vibration directions of the first diaphragm 21 and the second diaphragm 22 are opposite. Since a drive force provided by the magnetic circuit system 30 is the same, the vibration of the speaker can be offset.

The vibration system 20 further includes a first voice coil assembly 23 inserted into the magnetic gap to drive the first diaphragm 21 to vibrate and produce sounds, and a second voice coil assembly 24 inserted into the magnetic gap to drive the second diaphragm 22 to vibrate and produce sounds.

The first diaphragm 21 includes a first dome 211 located in the center, a first curved ring 212 which surrounds the first dome 211 and is fixed to the frame 10, and a first dome connecting wall 213 formed by extending from the first dome 211 towards the first voice coil assembly 23; and the first dome 211 and the first dome connecting wall 213 are integrated.

The second diaphragm 22 includes a second dome 221 located in the center, a second curved ring 222 which surrounds the second dome 221 and is fixed to the frame 10, and a second dome connecting wall 223 formed by extending from the second dome 221 towards the first voice coil assembly 24; and the second dome 221 and the second dome connecting wall 223 are integrated.

The first dome 211 and the first dome connecting wall 213, and the second dome 221 and the second dome connecting wall 223 are integrally injection-molded, and the curved rings and elastic waves are connected, so that the vibration system 20 has better vibration balance.

The vibration system 20 further includes a first elastic wave assembly 25 and a second elastic wave assembly 26 which are fixed to the frame 10 and are spaced from each other; one end of the first elastic wave assembly 25 away from the frame 10 is connected to the first dome connecting wall 213; one end of the second elastic wave assembly 26 away from the frame 10 is connected to the second dome connecting wall 223; and the first elastic wave assembly 25 and the second elastic wave assembly 26 are in staggered distribution and have antiphase vibration.

In this embodiment, the first elastic wave assembly 25 and the second elastic wave assembly 26 are in staggered distribution and they have antiphase vibration. By this structure, the first elastic wave assembly 25 and the second elastic wave assembly 26 make reasonable use of an internal space of the speaker, the height of the speaker is reduced, and thinning development is facilitated. Meanwhile, a double-vibration-diaphragm effective vibration area is realized, the vibration loudness of the speaker is improved to a large extent, and the acoustic performance is improved.

Referring to FIG. 1 to FIG. 7, the frame 10 includes a first frame 11, and a second frame 12 stacked and fixed to the first frame 11 along the vibration direction of the vibration system 20. The first frame 11 fixes the first diaphragm 21, and the second frame 12 fixes the second diaphragm 22.

Figure 4:
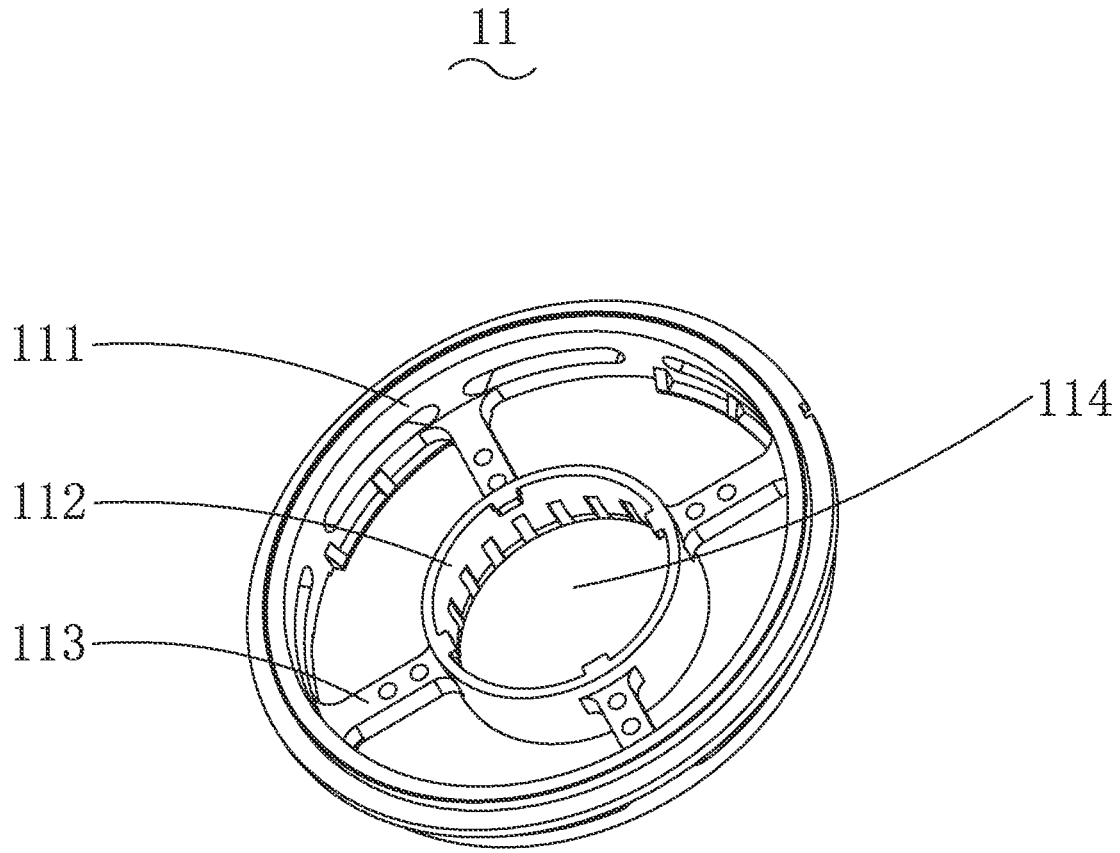
FIG. 4 is a schematic structural diagram of a first frame provided by the present invention.
Figure 5:
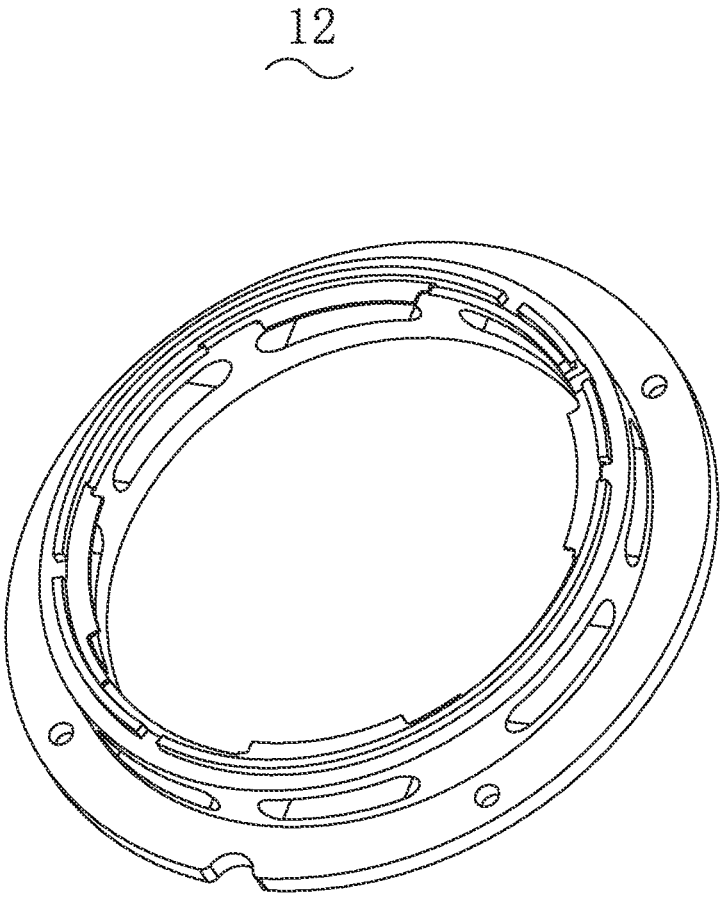
FIG. 5 is a schematic structural diagram of a second frame provided by the present invention.
Figure 6:
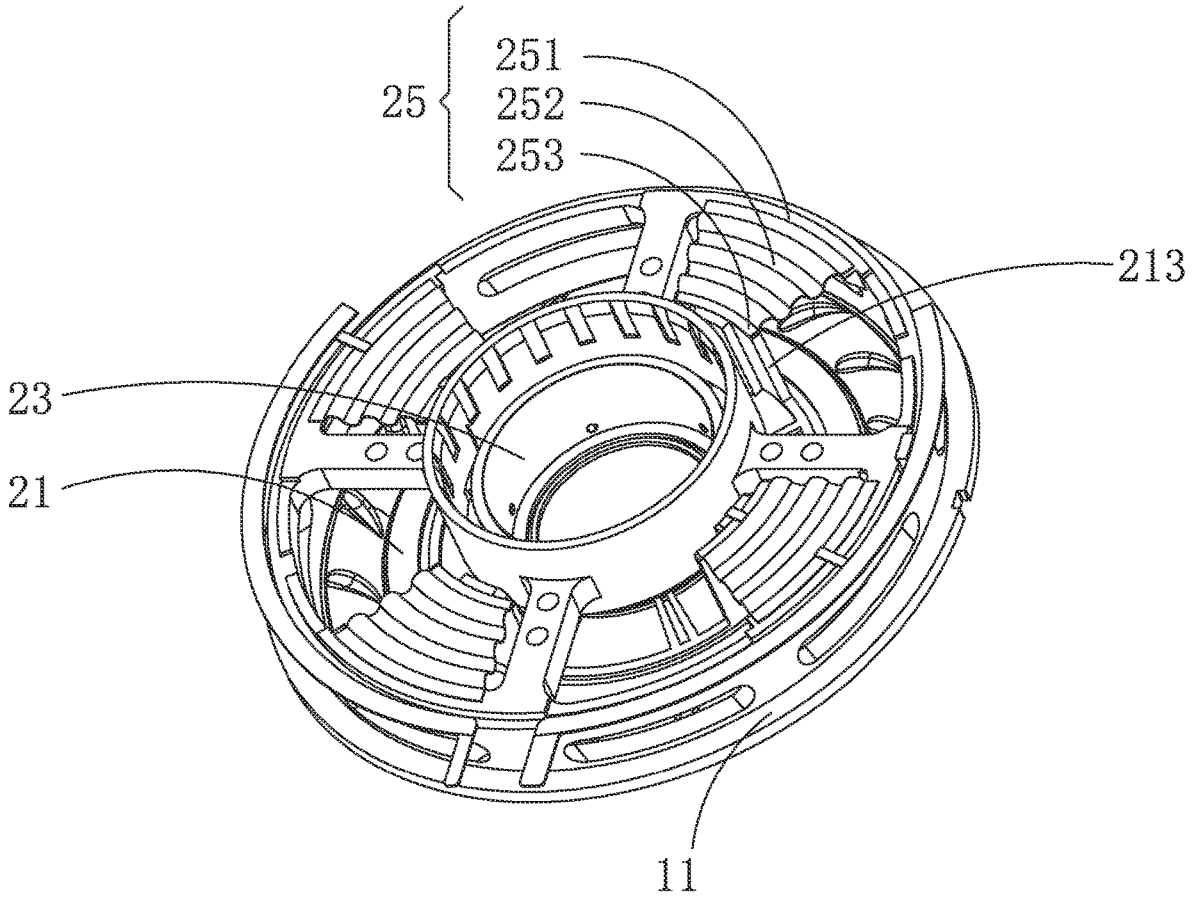
FIG. 6 is a schematic structural diagram of assembling of a first frame and a first vibration system provided by the present invention.
Figure 7:
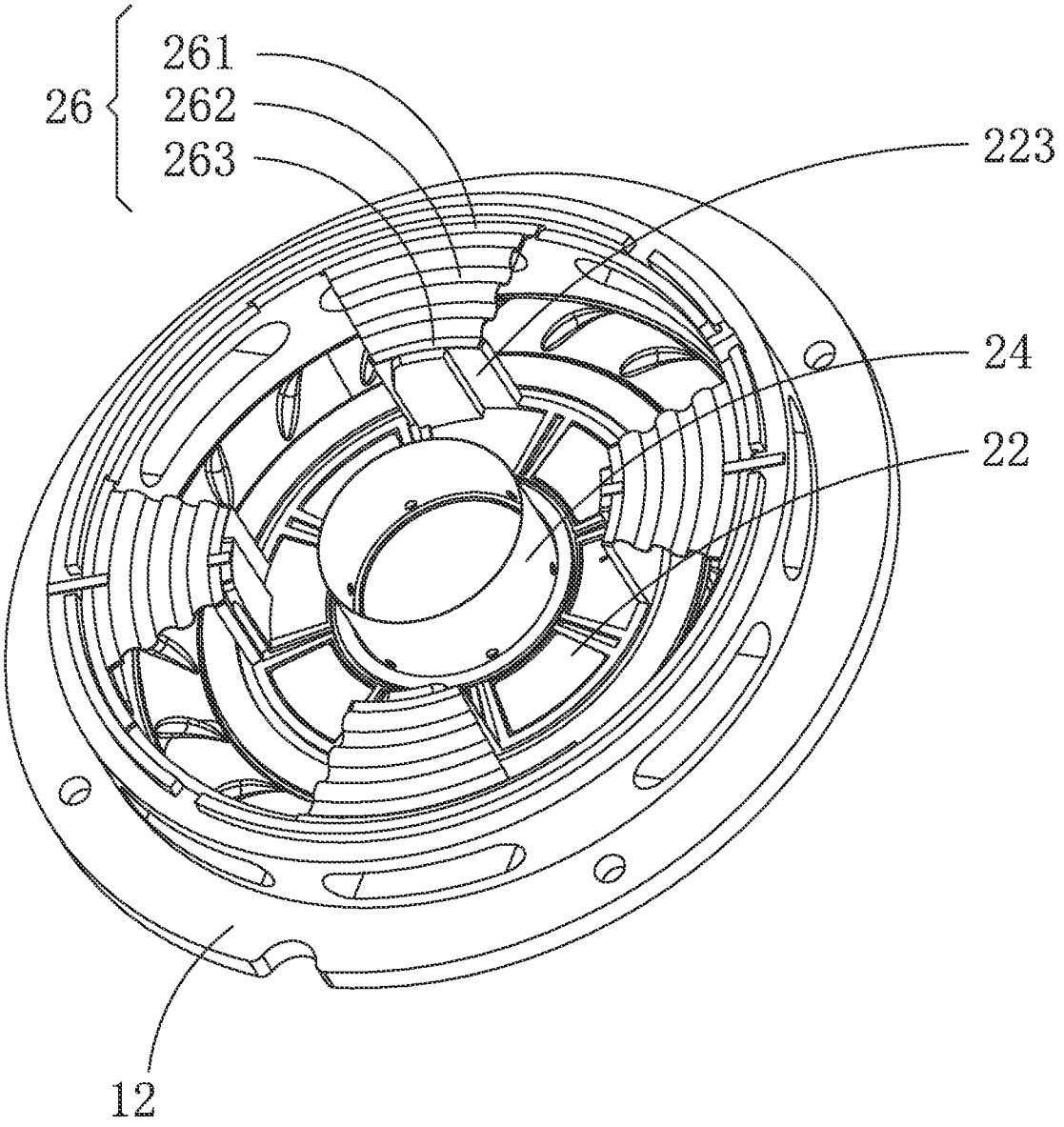
FIG. 7 is a schematic structural diagram of assembling of a second frame and a second vibration system provided by the present invention.

In particular, referring to FIG. 4, the first frame 11 includes a frame body 111 for fixing the first diaphragm 21, a supporting part 112 spaced from the frame body 111, and several frame extending arms 113 extending from the frame body 111 to the supporting part 112; and a through hole 114 that runs through the supporting part 112 and fixes the magnetic circuit system 30 is formed in the supporting part 112 along the vibration direction. Similarly, in other embodiments, the second frame 12 is provided with the above structures to fix the magnetic circuit system 30. That is, the second frame 12 includes a frame body, a supporting part spaced from the frame body, and several frame extending arms extending from the frame body to the supporting part; and a through hole that runs through the supporting part and fixes the magnetic circuit system is formed in the supporting part along the vibration direction.

In the production and assembling process, by the first frame 11 and the second frame 12, after components of the vibration system 20 and the magnetic circuit system 30 are assembled, the vibration system and the magnetic circuit system are then fixed by a mortise and tenon joint structure or gluing, thus stacking and forming one complete frame 10. This structure is favorable for saving assembling procedures and compressing the overall space of the speaker. Furthermore, this structure improves the fixing strength of the magnetic circuit system 30 and improves the reliability of the speaker.

A mounting part is convexly arranged on one side of the first frame 11 facing the second frame 12; an avoiding part matched with the mounting part is sunken in a position, corresponding to the mounting part, on the second frame 12. Similarly, in other embodiments, a mounting part is convexly arranged on one side of the second frame 12 facing the first frame 11; and an avoiding part matched with the mounting part is sunken in a position, corresponding to the mounting part, on the first frame 11.

The mounting part and the avoiding part on the first frame 11 and the second frame 12 are used for realizing their snap-in connection and horizontal positioning, so that a space required for combined connection between and horizontal positioning of the first frame and the second frame can be reduced. A larger accommodating space is provided for internal elements of the speaker, the thickness of the overall speaker is reduced, and the speaker is developed towards miniaturization.

One or more air vents are formed in a side wall of the first frame 11 and a side wall of the second frame 12.

Each first elastic wave assembly 25 includes a first elastic wave fixing part 251, a first elastic wave edge part 252, and a first elastic wave connection part 253 for connecting the first elastic wave fixing part 251 with the first elastic wave edge part 252; the first elastic wave fixing part 251 is fixed on the first frame 11; and the first elastic wave edge part 252 is connected to the first dome connecting wall 213.

Each second elastic wave assembly 26 includes a second elastic wave fixing part 261, a second elastic wave edge part 262, and a second elastic wave connection part 263 for connecting the second elastic wave fixing part 261 with the second elastic wave edge part 262; the second elastic wave fixing part 261 is fixed on the second frame 12; and the second elastic wave edge part 262 is connected to the second dome connecting wall 223.

The cross sections of the first elastic wave connection part 253 and the second elastic wave connection part 263 along the vibration directions are both waved. The waved elastic wave assemblies have higher vibration attenuation performance, which is conductive to improving the stability of vibration of the vibration system 20, thus improving the product performance of the speaker.

In the present embodiment, four first elastic wave assemblies 25 and four second elastic wave assemblies 26 are arranged and are spaced from one another. Correspondingly, four first dome connecting walls 213 and four second dome connecting walls 214 are arranged. In other embodiments, the number of the first elastic wave assemblies 25 and the number of the second elastic wave assemblies 26 may also be other numerical values. More preferably, the first elastic wave assemblies 25 and the second elastic wave assemblies 26 are located on the same horizontal plane.

The frame 10 further includes a fixing sheet 13 arranged between the first frame 11 and the second frame 12; part of the first elastic wave assembly 25 is fixed between the first frame 11 and the second frame 12 through the fixing sheet 13. Specifically, two centrosymmetric first elastic wave assemblies 25 include first connecting walls 254 and second connecting walls 255. The first elastic wave edge parts 252 are connected with the first dome connecting wall 213 through the first connecting walls 254, and the first elastic wave fixing parts 251 are bonded with the fixing sheet 13 through the second connecting walls 255, so that the first elastic wave assemblies 25 are fixed between the first frame 11 and the second frame 12. The fixing sheet 13 enhances the connection between the first elastic wave assemblies 25 and the first frame 11 as well as the second frame 12. Similarly, in other embodiments, the second elastic wave assemblies 26 are provided with the above structures, so as to be fixed between the first frame 11 and the second frame 12.

In the present embodiment, the first curved ring 212 includes a first curved ring main body 2121 with annular shape, a first fixed part 2122 which extends in a bent manner from an outer circumference of the first curved ring main body 2121 and is fixed to the first frame 11, and a first connection part 2123 extending in a bent manner from an inner circumference of the first curved ring main body 2121; the first dome 211 is fixed to the first connection part 2123; the second curved ring 222 includes a second curved ring main body 2221 with annular shape, a second fixed part 2222 which extends in a bent manner from an outer circumference of the second curved ring main body 2221 and is fixed to the second frame 12, and a second connection part 2223 extending in a bent manner from an inner circumference of the second curved ring main body 2221; and the second dome 221 is fixed to the second connection part 2223.

One side of the first dome 211 close to the magnetic circuit system 30 is fitted with several gaskets directly facing a first pole plate 33 and a third pole plate 35 (a bottom wall 352 of the third pole plate).

In the present embodiment, the magnetic gap includes a first magnetic gap 41 close to one side of the first diaphragm 21 and a second magnetic gap 42 which is close to one side of the second diaphragm 22 and is spaced from the first magnetic gap 41.

The first voice coil assembly 23 includes a first voice coil bobbin 231 fixed to the first diaphragm 21 and a first voice coil 232 wound on the first voice coil bobbin 231; the first voice coil 232 is at least partially located in the first magnetic gap 41; the second voice coil assembly 24 includes a second voice coil bobbin 241 fixed to the second diaphragm 22 and a second voice coil 242 wound on the second voice coil bobbin 241; and the second voice coil 242 is at least partially located in the second magnetic gap 42.

The first voice coil 232 is at least partially located in the first magnetic gap 41, and the second voice coil 242 is at least partially located in the second magnetic gap 42, thus generating an electromagnetic field together with the magnetic circuit system 30, which realizes generation of a magnetic drive force and drives the first voice coil 232 and the second voice coil 242 to move in a reciprocating manner, so that the vibration system 20 vibrates in a reciprocating manner and produces sounds.

The first voice coil bobbin 231 further includes a first leakage hole 233 running through the first voice coil bobbin 231, and the second voice coil bobbin 241 further includes a second leakage hole 243 running through the second voice coil bobbin 241.

The first leakage hole 233 and the second leakage hole 243 are used for improving the reliability of pressure relief during the vibration of the vibration system 20. More preferably, a plurality of first leakage holes 233 and a plurality of second leakage holes 243 are provided and are disposed at equal intervals, so as to realize pressure relief balance and improve the stability.

In the speaker of the embodiments of the present invention, in the vibration system 20, a first vibration system is composed of the first diaphragm 21, the first voice coil assembly 23, and the first elastic wave assembly 25; the first vibration system is fixed on the first frame 11; a second vibration system is composed of the second diaphragm 22, the second voice coil assembly 24, and the second elastic wave assembly 26; the second vibration system is fixed on the second frame 12. The first vibration system and the second vibration system may be separately assembled and modularly manufactured.

In the present embodiment, the magnetic circuit system 30 includes a bobbin 31 which is opened along the vibration direction of the vibration system 20, a magnetic steel 32 fixed in the bobbin 31 and spaced from an inner wall of the bobbin 31, a first pole plate 33 fixed on one side of the magnetic steel 32 close to the first diaphragm 21, the second pole plate 34 fixed to one side of the magnetic steel 32 close to the second diaphragm 22, and the third pole plate 35 fixed outside the bobbin and spaced from an outer wall of the bobbin 31; and the first pole plate 33 and the third pole plate 35 form a magnetic bowl through the bobbin 31.

Figure 8:
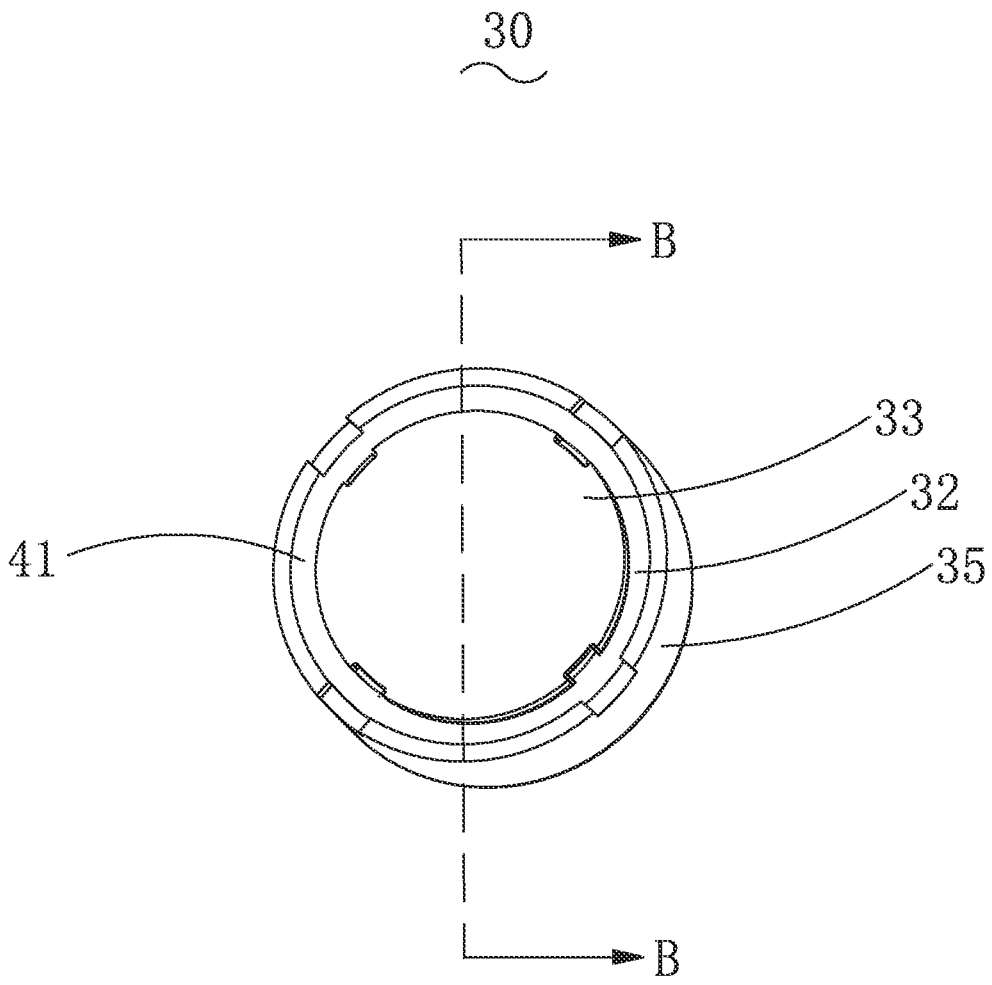
FIG. 8 is a schematic structural diagram of a magnetic circuit system provided by the present invention.
Figure 9:
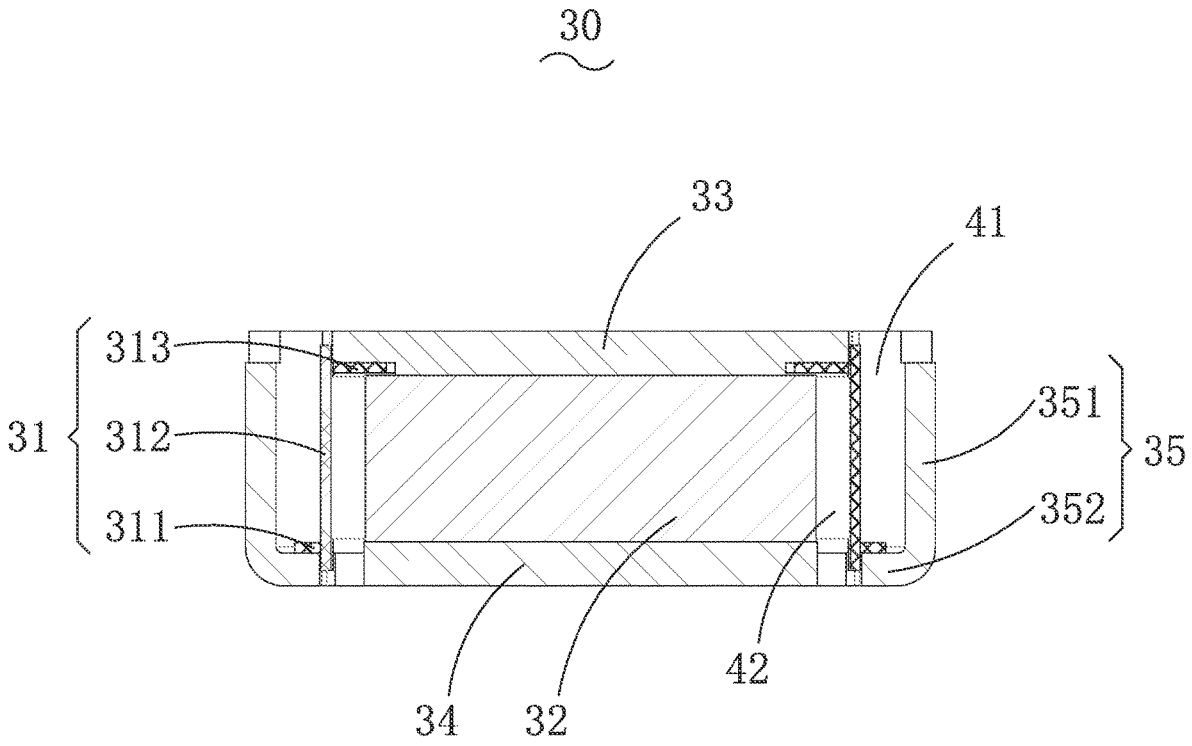
FIG. 9 is a cutaway view of FIG. 8 along the B-B direction.
Figure 10:
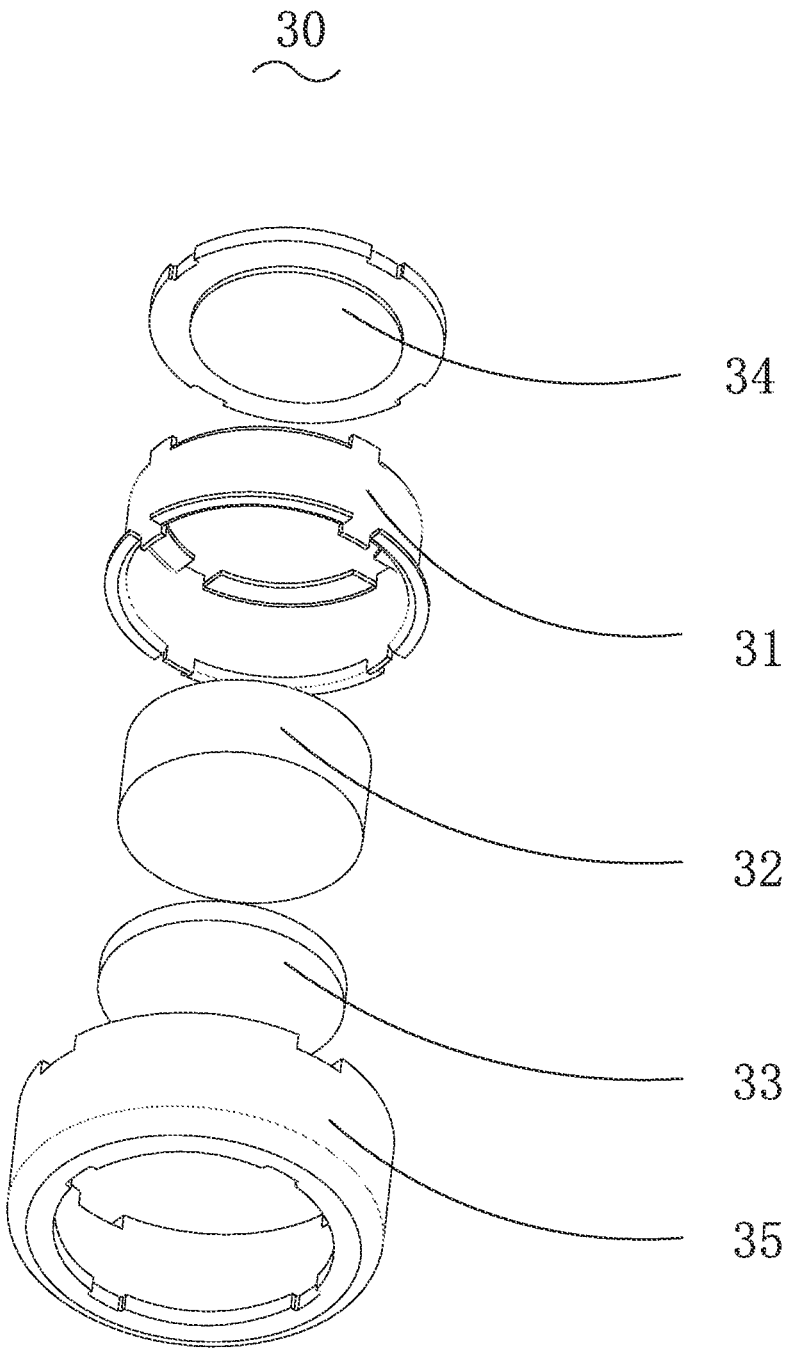
FIG. 10 is a schematic diagram of an exploded three-dimensional structure of a magnetic circuit system provided by the present invention.

Further, referring to FIG. 8 to FIG. 10, the bobbin 31 includes a bobbin bottom wall 311 sleeved on an outer circumferential edge of the second pole plate 34 in a spacing manner, a bobbin side wall 312 extending in a bent manner from an inner circumferential edge of the bobbin bottom wall 311 towards the first diaphragm 21, and a bobbin extending arm 313 which extends in a bent manner from the bobbin side wall 312 towards a direction close to the first pole plate 32 and is parallel to the bobbin bottom wall 311; and the bobbin extending arm 313 is fixed to one side of the magnetic steel 32 close to the first diaphragm 21. Further, the bobbin is made of a non-magnetoconductive material, which may specifically be aluminum, copper, plastic, etc.

The third pole plate 35 includes a third pole plate side wall 351 sleeved on the outer side of the bobbin side wall 312 in a spacing manner, and a third pole plate bottom wall 352 which extends in a bent manner from the third pole plate side wall 351 towards a direction close to the second pole plate 34 and is parallel to the bobbin bottom wall 311; and the third pole plate bottom wall 352 is fixed to the bobbin bottom wall 311. The magnetic circuit system 30 is fixed in the through hole 114 through the third pole plate 35.

Preferably, the bobbin extending arm 313 is fixed to the magnetic steel 32, the third pole plate bottom wall 352, and the bobbin bottom wall 311 in a glued, riveted, or welded manner.

The magnetic circuit system 30 provides a magnetic field through the magnetic steel 32, and a closed magnetic field is formed via the first pole plate 33, the third pole plate 35, and the second pole plate 34. The first pole plate 33 and the third pole plate 35 form the first magnetic gap 41, and the first voice coil 232 is inserted into the first magnetic gap 41 for movement, so as to drive the first diaphragm 21 to vibrate and produce sounds. The second pole plate 34 and the third pole plate 35 form the second magnetic gap 42, and the second voice coil 242 is inserted into the second magnetic gap 42 for movement, so as to drive the second diaphragm 22 to vibrate and produce sounds. The second magnetic gap 42 and the first magnetic gap 41 are formed on the inner side and the outer side of the bobbin 31.

In the speaker of the embodiments of the present invention, at the same current, drive forces of the first voice coil 232 and the second voice coil 242 are the same, that is, upper and lower BLs are the same. Furthermore, the first voice coil 232 and the second voice coil 242 move inside and outside in a staggered manner, which saves a Z-directional space of the speaker and achieves higher magnetic field efficiency.

The embodiments of the present invention are described above only. It should be noted that those of ordinary skill in the art can further make improvements without departing from the concept of the present invention. These improvements shall all fall within the protection scope of the present invention.

What is claimed is:

1. A speaker, comprising a frame, a vibration system fixed to the frame, and a magnetic circuit system with a magnetic gap, wherein the vibration system comprises a first diaphragm and a second diaphragm which are fixed to two opposite sides of the frame, a first voice coil assembly inserted into the magnetic gap to drive the first diaphragm to vibrate and produce sounds, and a second voice coil assembly inserted into the magnetic gap to drive the second diaphragm to vibrate and produce sounds;

the first diaphragm comprises a first dome located in the center, a first curved ring which surrounds the first dome and fixed to the frame, and a first dome connecting wall formed by extending from the first dome towards the first voice coil assembly; the second diaphragm comprises a second dome located in the center, a second curved ring which surrounds the second dome and is fixed to the frame, and a second dome connecting wall formed by extending from the second dome towards the second voice coil assembly; the first dome and the first dome connecting wall, and the second dome and the second dome connecting wall are integrated respectively;

the vibration system further comprises a first elastic wave assembly and a second elastic wave assembly which are fixed to the frame and are spaced from each other; one end of the first elastic wave assembly away from the frame is connected to the first dome connecting wall; one end of the second elastic wave assembly away from the frame is connected to the second dome connecting wall; and the first elastic wave assembly and the second elastic wave assembly are in staggered distribution and antiphase vibration.

2. The speaker of claim 1, wherein the frame comprises a first frame for fixing the first diaphragm and a second frame for fixing the second diaphragm;

the first frame is stacked on the second frame along a vibration direction of the vibration system; a mounting part is convexly arranged on one side of the first frame facing the second frame; an avoiding part matched with the mounting part is sunken in a position, corresponding to the mounting part, on the second frame;

or, a mounting part is convexly arranged on one side of the second frame facing the first frame; and an avoiding part matched with the mounting part is sunken in a position corresponding to the mounting part on the first frame.

3. The speaker of claim 2, wherein there are four first dome connecting walls and four second dome connecting walls, and four first elastic wave assemblies and four second elastic wave assemblies.

4. The speaker of claim 3, wherein the frame further comprises a fixing sheet arranged between the first frame and the second frame; a part of the first elastic wave assembly is fixed between the first frame and the second frame through the fixing sheet;

or, a part of the second elastic wave assembly is fixed between the first frame and the second frame through the fixing sheet.

5. The speaker of claim 2, wherein the first curved ring comprises a first curved ring main body with annular shape, a first fixed part which extends in a bent manner from an outer circumference of the first curved ring main body and is fixed to the first frame, and a first connection part extending in a bent manner from an inner circumference of the first curved ring main body; the first dome is fixed to the first connection part; the second curved ring comprises a second curved ring main body with annular shape, a second fixed part which extends in a bent manner from an outer circumference of the second curved ring main body and is fixed to the second frame, and a second connection part extending in a bent manner from an inner circumference of the second curved ring main body; and the second dome is fixed to the second connection part.

6. The speaker of claim 2, wherein the first frame comprises a frame body, a supporting part spaced from the frame body, and a plurality of frame extending arms extending from the frame body to the supporting part; a through hole that runs through the supporting part and fixes the magnetic circuit system is formed in the supporting part along the vibration direction; or, the second frame comprises a frame body, a supporting part spaced from the frame body, and a plurality of frame extending arms extending from the frame body to the supporting part; and a through hole that runs through the supporting part and fixes the magnetic circuit system is formed in the supporting part along the vibration direction.

7. The speaker of claim 1, wherein the magnetic gap comprises a first magnetic gap close to one side of the first diaphragm and a second magnetic gap which is close to one side of the second diaphragm and is spaced from the first magnetic gap.

8. The speaker of claim 7, wherein the first voice coil assembly comprises a first voice coil bobbin fixed to the first diaphragm and a first voice coil wound on the first voice coil bobbin; the first voice coil is at least partially located in the first magnetic gap; the second voice coil assembly comprises a second voice coil bobbin fixed to the second diaphragm and a second voice coil wound on the second voice coil bobbin; and the second voice coil is at least partially located in the second magnetic gap.

9. The speaker of claim 8, wherein the first voice coil bobbin further comprises a first leakage hole running through the first voice coil bobbin, and the second voice coil bobbin further comprises a second leakage hole running through the second voice coil bobbin.

* * * * *